US011105220B2

(12) United States Patent
Baskaran et al.

(10) Patent No.: US 11,105,220 B2
(45) Date of Patent: Aug. 31, 2021

(54) TURBINE ELEMENT CLEANING PROCESS

(71) Applicant: United Technologies Corporation, Farmington, CT (US)

(72) Inventors: Karthikeyan Baskaran, Serangoon (SG); Balaji Rao Garimella, the linear (SG)

(73) Assignee: Raytheon Technologies Corporation, Farmington, CT (US)

( * ) Notice: Subject to any disclaimer, the term of this patent is extended or adjusted under 35 U.S.C. 154(b) by 132 days.

(21) Appl. No.: 16/127,438

(22) Filed: Sep. 11, 2018

(65) Prior Publication Data

US 2019/0093506 A1 Mar. 28, 2019

(30) Foreign Application Priority Data

Sep. 22, 2017 (SG) ..... 10201707848U

(51) Int. Cl.

| | |
|---|---|
| ***F01D 25/00*** | (2006.01) |
| ***F01D 5/18*** | (2006.01) |
| ***B08B 7/02*** | (2006.01) |
| ***B08B 9/032*** | (2006.01) |
| ***F01D 25/28*** | (2006.01) |
| ***F01D 5/00*** | (2006.01) |

(52) U.S. Cl.

CPC ..... *F01D 25/002* (2013.01); *B08B 7/02* (2013.01); *B08B 9/0321* (2013.01); *F01D 5/005* (2013.01); *F01D 5/18* (2013.01); *F01D 25/285* (2013.01); *F05D 2230/72* (2013.01); *F05D 2230/80* (2013.01); *F05D 2240/30* (2013.01); *F05D 2260/20* (2013.01); *F05D 2260/607* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,271,925 | A * | 6/1981 | Burg | G01V 1/133 181/106 |
| 4,439,241 | A | 3/1984 | Ault et al. | |
| 4,590,636 | A | 5/1986 | Wehrmann | |
| 5,464,479 | A | 11/1995 | Kenton et al. | |
| 5,707,453 | A | 1/1998 | Shurman et al. | |

(Continued)

FOREIGN PATENT DOCUMENTS

| | | |
|---|---|---|
| EP | 3167966 A2 | 5/2017 |
| WO | 2017-115643 A1 | 7/2017 |

OTHER PUBLICATIONS

CP 9361 Air Hammer, Feb. 2000, Chicago Pneumatic Tool Company LLC, Rock Hill, South Carolina.

(Continued)

*Primary Examiner* — Erin F Bergner
(74) *Attorney, Agent, or Firm* — Bachman & LaPointe, P.C.

(57) ABSTRACT

In a method for processing a turbomachine airfoil element, the airfoil element comprises a metallic substrate having: an airfoil extending from a first end to a second end; and a cooling passageway system extending through the airfoil. The method comprises: applying an external vibration to an area of the airfoil element targeting internal fouling of the cooling passageway system; flushing the cooling passageway system; and imaging the cooling passageway system.

16 Claims, 6 Drawing Sheets

(56) References Cited

U.S. PATENT DOCUMENTS

| | | | | |
|---|---|---|---|---|
| 6,500,269 | B2 | 12/2002 | Risbeck et al. | |
| 2005/0145266 | A1 | 7/2005 | Velez, Jr. | |
| 2015/0196869 | A1* | 7/2015 | Zwayyed | B01D 53/505 134/37 |
| 2017/0130649 | A1* | 5/2017 | Bewlay | B08B 9/0321 |
| 2017/0209904 | A1 | 7/2017 | Eriksen et al. | |
| 2018/0207689 | A1 | 7/2018 | Takeuchi et al. | |

OTHER PUBLICATIONS

Extended Search Report dated Sep. 6, 2019 for European Patent Application No. 18196055.0.
Partial Search Report dated Mar. 21, 2019 for European Patent Application No. 18196055.0.
Singapore Office Action dated Apr. 1, 2021 for Singapore Patent Application No. 10201707848U.

* cited by examiner

TURBINE ELEMENT CLEANING PROCESS

BACKGROUND

The disclosure relates to gas turbine engine repair and servicing. More particularly, the disclosure relates to the repair and restoration of airfoil elements from gas turbine engines.

Gas turbine engines (broadly inclusive of industrial gas turbines, turbofans, turbojets, turboshafts, turboprops, and the like) are subject to periodic or other servicing requiring the removal, cleaning, inspection, and repair or restoration of individual components. Of particular note are the airfoil elements (blades and vanes) of the turbine section(s) of such engines. Turbine blades and vanes are typically formed of high temperature alloys, generally nickel-based superalloys. The elements have internal cooling passage systems (e.g., with inlets typically along the roots of blades and along either an inner diameter platform or outer diameter shroud of vanes).

At least along the exterior of the airfoil, the turbine elements typically also bear a thermal barrier coating system. Exemplary thermal barrier coating systems comprise one or more bondcoat layers (often metallic) and one or more barrier layers (typically ceramic). Additionally, abradable and/or abrasive coatings may be located such as at the blade tip for engaging the inner diameter surface of a blade outer airseal (BOAS).

So-called cantilevered vanes only have outer diameter shrouds and may have inner diameter ends similar to outer diameter ends of blades. Typical blade outer diameter ends are formed by a tip of the blade airfoil bearing an abrasive coating. Other blades include shrouds at the outer diameter end of the airfoil. Such shrouds may bear sealing teeth or the like.

The cooling passageway systems include outlets. Typically, the outlets include outlets along the airfoil itself such as outlets adjacent the leading edge, outlets adjacent the trailing edge (e.g., a discharge slot), outlets along the respective suction side and/or pressure side, and outlets at blade tips. Additional outlets may be along gaspath-facing surfaces of platforms or shrouds. For vanes, in particular, there may be one or more large outlets along the non-gaspath-facing surface of whichever of the platform and shroud does not bear the inlet(s).

In service, numerous wear, damage, fouling, and the like may occur. Coatings may become worn or delaminated. Wear may extend down to substrate material. There may be chipping or other foreign object damage. Fine cooling passageway outlets may become plugged and larger accumulations of material may foul even feed passageway portions of the cooling passageway system. Tip wear and cracking is also a relevant consideration for blades.

Thus, an exemplary servicing process for blades involves cleaning, optional coating removal, inspection, machining at wear or damage locations, subsequent repair/restoration (e.g., build-up weld repairs, tip cap replacement, and the like), and recoating).

In a service operation, the airfoil elements are typically processed in their respective stages of the engine. For example, all the blades of a given stage may be removed from the associated disk and processed as a batch. Many alternatives exist including aggregating like blades from multiple engines. These blades are sent to repair shops to restore to the original condition. The blades are initially sent for grit blasting to remove the top ceramic coat. Once blasted, the parts are checked if they are salvageable (e.g., based on visual inspection). If the parts are salvageable, they are sent for internal cavity cleaning.

A typical internal cleaning process is an iterative process including radiographic imaging inspection. An exemplary baseline initial cleaning process 201 (FIG. 6) comprises an autoclave chemical cleaning or leaching 210. This may be performed on individual blades or groups as discussed above. The leaching is performed using an alkaline solution (e.g., KOH). The exemplary autoclaving involves an autoclave operating temperature of 400° F. to 450° F. (204° C. to 232° C.), an operating pressure of about 200 psi (1.4 MPa), and a hold time at operating temperature and pressure of 2.5 hours to 8.0 hours.

After the autoclave cleaning, a flushing 212 may be performed. An exemplary flushing is a high pressure water jet cleaning. An exemplary flushing comprises inserting one or more nozzles into the blade platform inlet(s) and blasting with deionized water at high pressure (e.g., 5000 psi to 8000 psi) (3.4 MPa to 5.5 kPa). This flushing tends to remove material left by the autoclaving. For example, the autoclaving may tend to loosen internal layers of sand and dust, leaving these relatively fragile.

After the flushing, a boiling step 214 and a conductivity check step 216 may be performed. In exemplary boiling, a body of water is heated to a boil. One or more of the elements may be placed in a tray and fully immersed in the boiling water and soaked for a period of time. The elements are removed and then rinsed in deionized water. During the rinse, the deionized water may accumulate material from moisture left after the boiling or from contaminants otherwise still inside the element. For the conductivity check 216, a sample of the rinse water is collected and its conductivity tested. A high conductivity will indicate the presence of dissolved solids and ions left over from the autoclave alkaline solution. An exemplary threshold is 5 micro-Siemens per centimeter. Excess conductivity mandates a reflushing.

Thereafter, there may be an oven dry 218 to remove residual water. Exemplary operating temperatures are 225° F. to 250° F. (107° C. to 121° C.) in a drying oven or atmospheric furnace.

Radiographic inspection 220 may involve installing one or more blades in a fixture. Exemplary fixtures are serialized to provide visible indication of the particular blade being tested in the radiographic image. Exemplary radiographic imaging is a digital x-ray.

FIG. 7 shows an exemplary radiographic image with areas of residual fouling 380 (dark spots) highlighted in light boxes. Upon detection of such areas of fouling, the process repeats. The process may repeat for many cycles. Thus, it may take many days to process a given stage of elements. The costs of this are substantial. It is not merely the time required for processing but labor and downtime. Also, there is a cost to unpredictability. A great variation in the amount of time needed for blade stages also imposes a predictability cost. Going in, one does not know whether a given stage of blades may require many days of cycles or only one or two days.

SUMMARY

One aspect of the disclosure involves a method for processing a turbomachine airfoil element, the airfoil element comprising a metallic substrate having: an airfoil extending from a first end to a second end; and a cooling passageway system extending through the airfoil. The method comprises: applying an external vibration to an area of the airfoil element targeting internal fouling of the cooling passageway system; flushing the cooling passageway system; and imaging the cooling passageway system.

A further embodiment of any of the foregoing embodiments may additionally and/or alternatively include an autoclave leaching between the applying and the flushing.

A further embodiment of any of the foregoing embodiments may additionally and/or alternatively include locating the internal fouling, if any remaining, via the imaging. The method further includes repeating: the applying, the applying targeting the located internal fouling; the flushing; the imaging; and the locating.

A further embodiment of any of the foregoing embodiments may additionally and/or alternatively include autoclave leaching after the vibrating and before the flushing.

A further embodiment of any of the foregoing embodiments may additionally and/or alternatively include conductivity testing and drying after the flushing and before the imaging.

A further embodiment of any of the foregoing embodiments may additionally and/or alternatively include the turbine element being a blade.

A further embodiment of any of the foregoing embodiments may additionally and/or alternatively include the internal fouling being along a turn in the passageway system.

A further embodiment of any of the foregoing embodiments may additionally and/or alternatively include the imaging being an x-ray imaging.

A further embodiment of any of the foregoing embodiments may additionally and/or alternatively include the applying being via a pneumatic vibrator.

A further embodiment of any of the foregoing embodiments may additionally and/or alternatively include the applying comprising placing a buffer between the substrate and the pneumatic vibrator.

A further embodiment of any of the foregoing embodiments may additionally and/or alternatively include the buffer comprising: a metallic strip having a first face and a second face opposite the first face; a cushion along the first face; and means along the second face for registering the pneumatic vibrator.

A further embodiment of any of the foregoing embodiments may additionally and/or alternatively include wherein the means comprising an elevated area surrounding a recess.

A further embodiment of any of the foregoing embodiments may additionally and/or alternatively include the cushion comprising a glass fiber tape.

Another aspect of the disclosure involves a buffer element for accommodating a vibrating tip to vibrate a workpiece, the buffer element comprising: a metallic strip having a first face and a second face opposite the first face; a cushion along the first face; and means along the second face for registering the vibrating tip.

A further embodiment of any of the foregoing embodiments may additionally and/or alternatively include the cushion comprising a glass fiber tape.

A further embodiment of any of the foregoing embodiments may additionally and/or alternatively include the means comprising an elevated area surrounding a recess.

A further embodiment of any of the foregoing embodiments may additionally and/or alternatively include the means comprising a piece of sheet metal tack welded to the second face.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
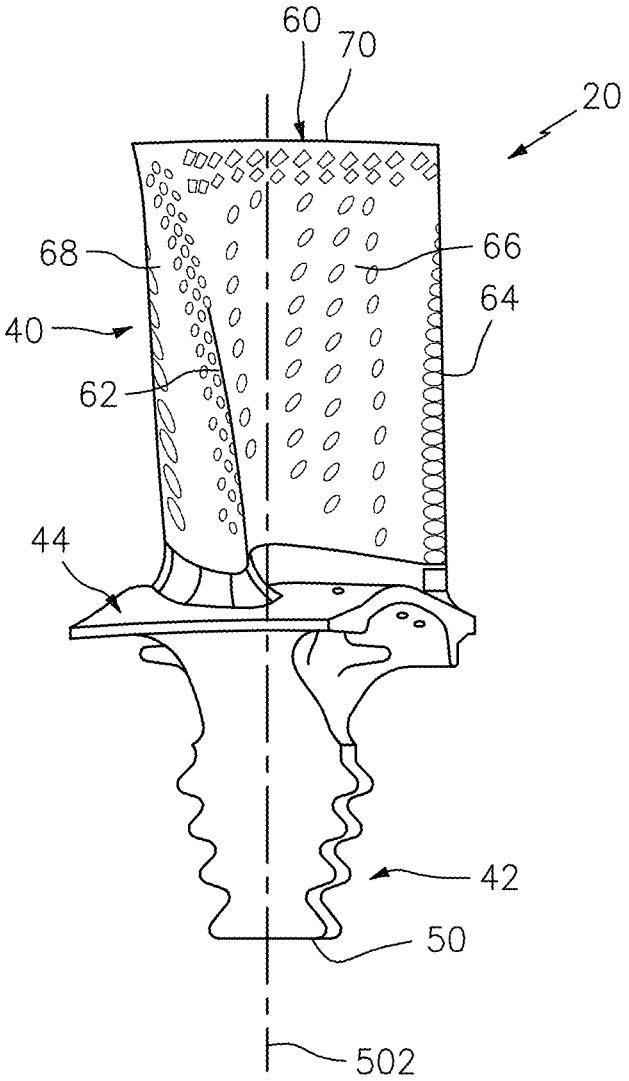
FIG. 1 is a front view of a turbine blade.
Figure 2:
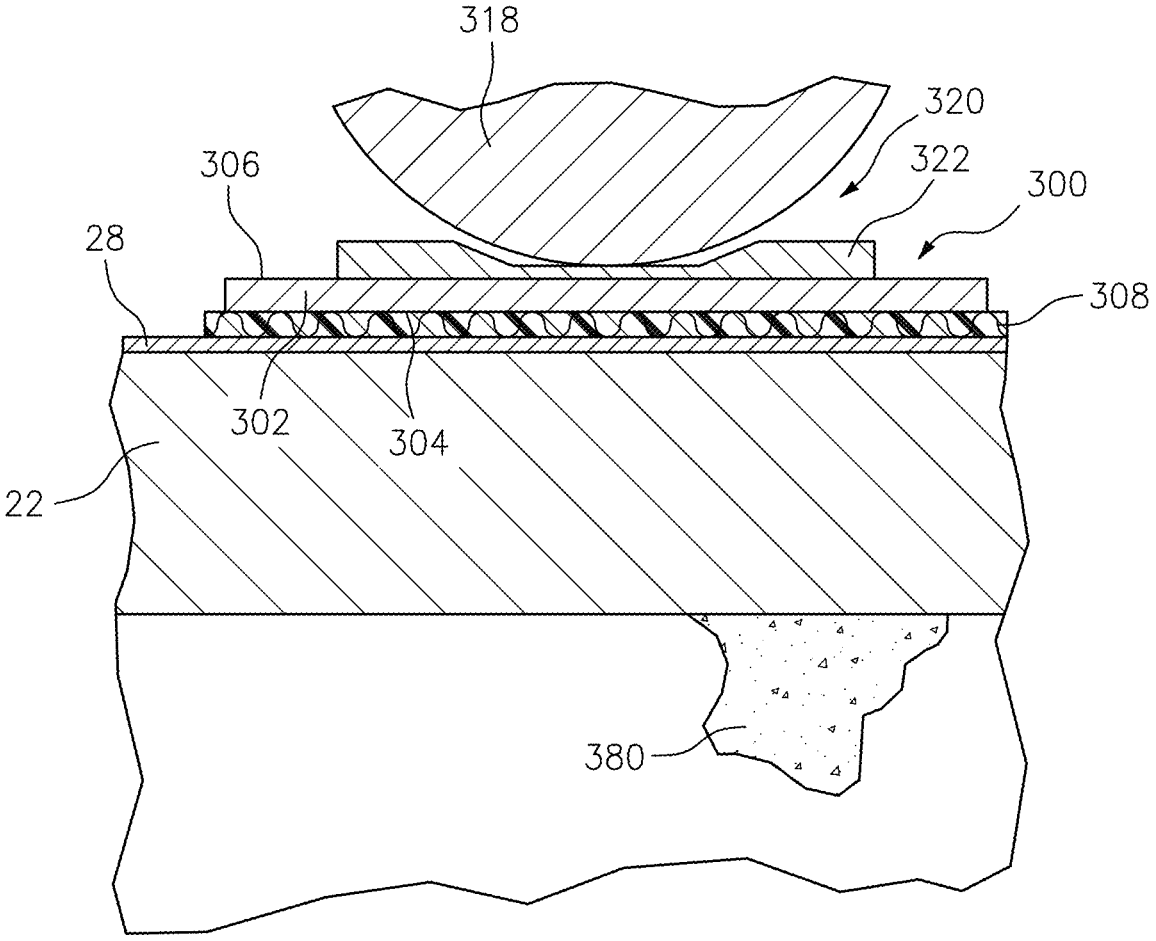
FIG. 2 is a partial cross-sectional view of an airfoil of the blade.

FIG. 1 shows a turbine blade 20. The blade comprises a metallic substrate 22 (FIG. 2). The blade may further comprise one or more coatings. As is discussed below, the exemplary coatings may include a thermal barrier coating (TBC) system and/or an abrasive coating system (not shown). Each of these coating systems may, in turn, include one or more layers. For example, the exemplary thermal barrier coating system includes a metallic bondcoat atop the substrate and a ceramic thermal barrier coating (TBC) layer atop the bondcoat. Similarly, the abrasive coating system may include a metallic underlayer (base layer) and an abrasive layer. The abrasive layer comprises a matrix and abrasive particles at least partially embedded in the matrix. In the illustrated FIG. 2 example, the ceramic layer(s) have been removed but at least a portion of the bondcoat 28 may remain.

An exemplary substrate comprises a unitary metallic casting (e.g., of a nickel-based superalloy) and defines the overall gross features of the blade. The substrate and blade thus include an airfoil 40 and an attachment feature 42 (e.g., a firtree root). The blade and substrate may further include a platform 44 between the airfoil and the firtree root.

The firtree root 42 extends from an inboard end 50 forming an inboard end of the blade to an outboard end at an underside of the platform. The airfoil 40 extends from an inboard end at an outer surface (gaspath-facing surface) of the platform to a tip 60. The airfoil extends from a leading edge 62 to a trailing edge 64 and has a pressure side surface 66 and a suction side surface 68.

The tip 60 has a primary radially-outward facing surface 70. The surface 70 may at least partially surrounds a tip squealer pocket (not shown) extending radially inward from the tip surface 70. As noted above, an abrasive coating may be applied along the surface 70 and the TBC system may be applied along the pressure and suction side surfaces and the gaspath-facing surface of the platform.

Figure 3:
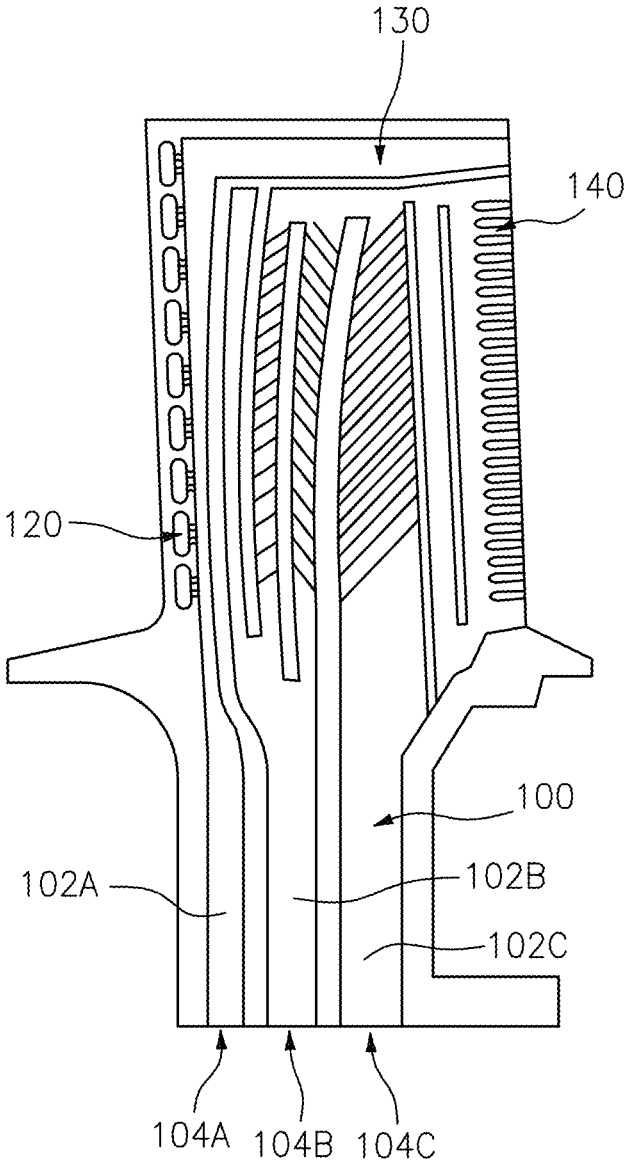
FIG. 3 is a spanwise/chordwise cutaway view of the blade.

FIG. 3 shows the cooling passageway system 100 as including multiple trunks 102A, 102B, 102C extending from respective outlets 104A, 104B, 104C along the inner diameter face of the root. Depending upon blade configuration, the trunks may branch in multiple spanwise cavities optionally with turns such that a cavity with tipward flow is termed an up-pass and a cavity leg with rootward flow is termed a down-pass. Additionally, there may be one or more impingement cavities such as a leading edge impingement cavity 120 fed by impingement holes from one of the up-pass or down-pass cavities and discharging via associated outlets to the airfoil exterior surface. Various of the cavity legs may discharge to the tip/tip pocket. Additionally, there may be a tip flag leg 130 passing in a rearward to the trailing edge from one of the more forward trunks. The exemplary trailing edge slot 140 is fed by the most rearward trunk.

Figure 5:
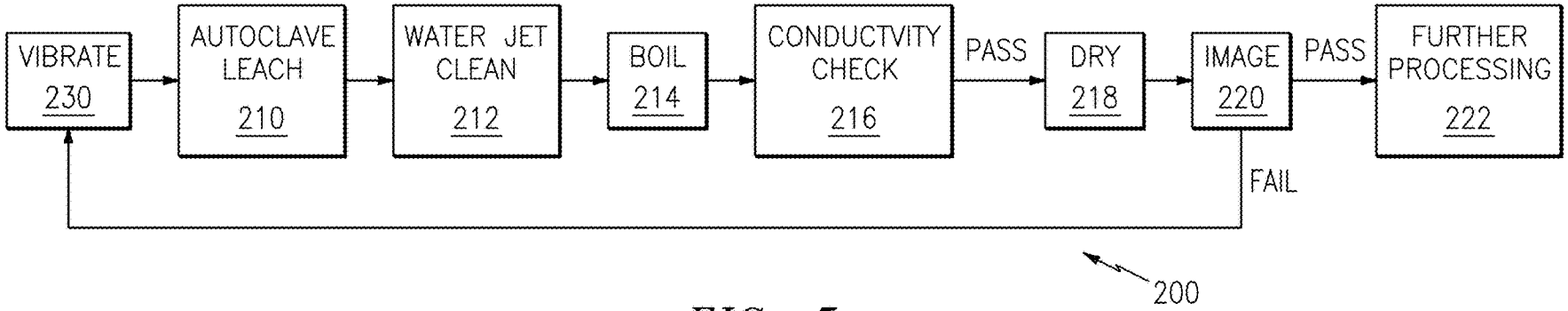
FIG. 5 is a cleaning process flowchart.
Figure 7:
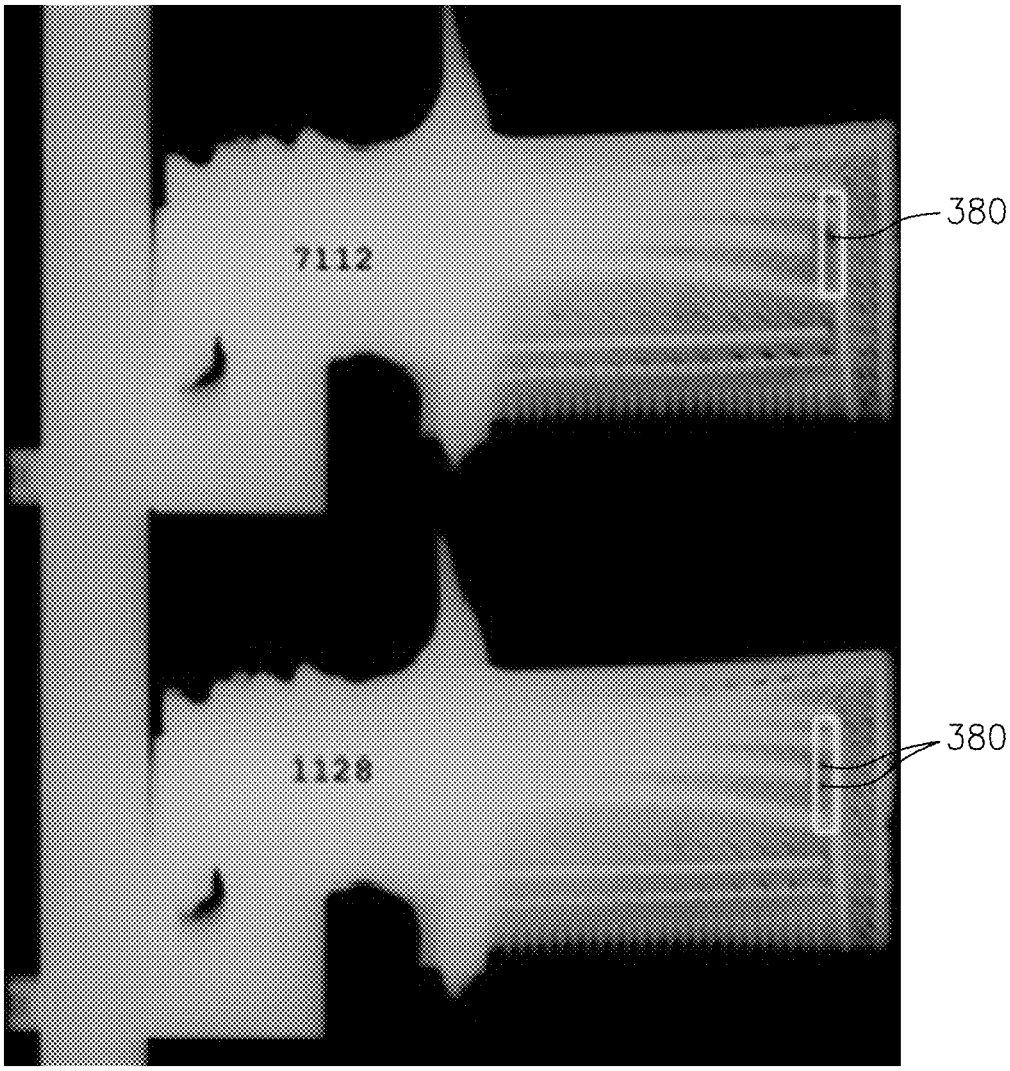
FIG. 7 is an x-ray image of a pair of blades showing fouling.

In an improved process 200 (FIG. 5), a vibrating step 230 is added to the baseline steps. The exemplary vibrating step is a targeted local vibrating via contacting a vibrator with the exterior of the turbine element. In particular, this is likely to be along a suction side or pressure side of the airfoil. As is discussed below, in at least some of the iterations, the particular location(s) for vibrating may be determined in response to the radiographic inspection 220.

In terms of modifying the exemplary baseline process 201, there may be multiple simple implementations or more complex implementations. For example, in one simple implementation, the vibrating 230 is performed only after the first iteration of the baseline process 201 and repeats through further iterations. In another implementation, an initial vibrating step 230 is performed at one or more locations which, via experience, are believed to be adjacent likely locations of fouling. In subsequent iterations, the targeting may be responsive to the inspection 220.

Figure 4:
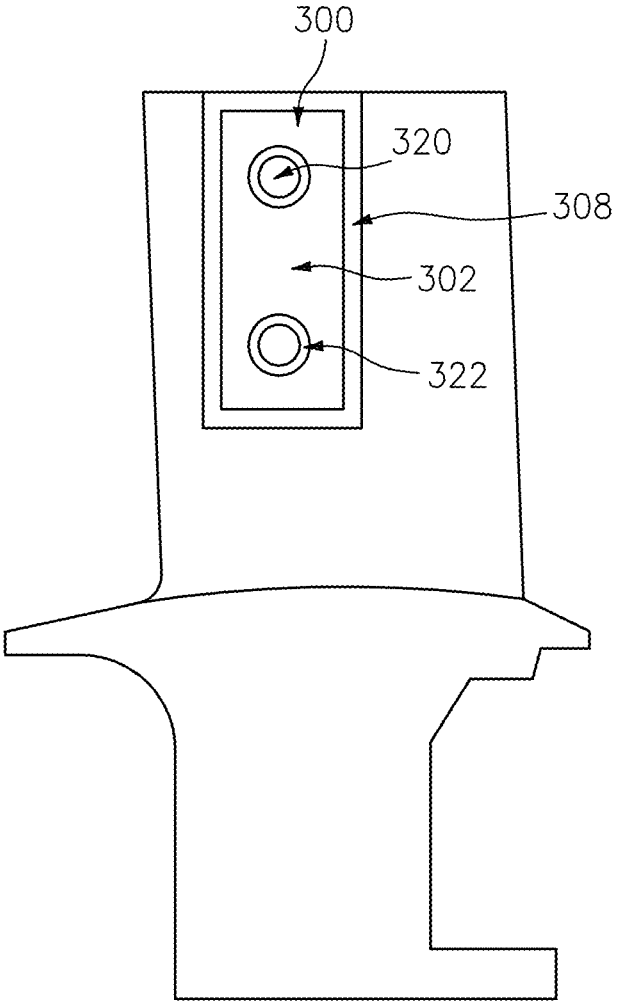
FIG. 4 is a view of a buffer member applied to the airfoil of the blade.
Figure 6:
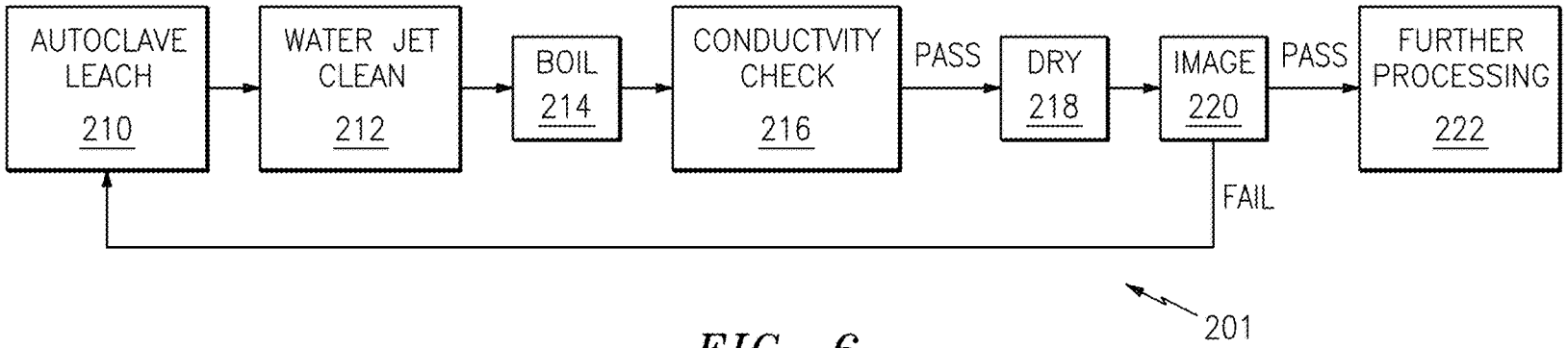
FIG. 6 (PRIOR ART)
FIG. 6 is a prior art cleaning process flowchart.

An exemplary vibrator is a pneumatic pen-type vibrator/air hammer such as used for engraving. CP 9361 air hammer, Chicago Pneumatic Tool Company LLC, Rock Hill, S.C. A buffer element or member 300 (FIG. 4) may be introduced between the vibrator and the turbine element. An exemplary buffer may serve one or more of at least two purposes. First, it may distribute force to avoid damaging the surface of the turbine element. Second, it may provide means for positioning the vibrator and retaining it in position. The positioning may comprise registering in a predetermined position. For example, an exemplary buffer may be sheet-like (e.g., comprising a metallic strip 302). An exemplary strip is SAE 1070 high-carbon steel strip. The strip has a first face 304 (FIG. 2) for engaging the turbine element and a second face 306 for engaging the vibrator. An exemplary strip thickness is 0.2 inch (5.1 mm), more broadly 2 mm to 8 mm. Along the first face, to further distribute and attenuate force, there may be a non-metallic layer 308 intervening between the strip and the element to serve as a cushion to prevent metal-to-metal contact to protect the part surface. For example, a tape layer may be applied to the first face. Exemplary tape is a high temperature glass fiber masking tape (e.g., Scotch® Performance Green Masking Tape 233+ glass-reinforced adhesive paper masking tape of 3M, St. Paul, Minn.). Exemplary tape thickness is 0.02 inch (0.5 mm), more broadly 0.1 mm to 1.0 mm. Exemplary tape width is about 2 cm and length is about 5 cm.

The positioning features may comprise recesses 320 along the second face for capturing the tip 318 of the vibrator. Exemplary recesses may be in elevated areas 322 so as to not actually be below the remainder of the second face 306. For example, one or more circular pieces may be tack welded to the first face 304 of a rectangular plate/strip 302 of steel. The circular pieces may be of a similar steel to the strip 302. An exemplary piece thickness is 0.2 inch (5.1 mm), more broadly 2 mm to 8 mm. The tack welding creates a recess in the exposed face of the circular pieces, leaving a perimeter as the associated elevated area 322. Exemplary recess depth is 0.5 mm to 10.0 mm (thus potentially below the ambient surface level of the strip), but leaving a thickness of at least 2.0 mm of strip thickness. Exemplary circular piece diameter is about 0.4 inch (10 mm) and exemplary recess diameter is about 0.2 inch (5.1 mm). Alternatively, the piece(s) may have a washer-like circular (annular) shape and be secured to the strip such as by welding so that their hole(s) define the recess(es).

In one example, the technician manually aligns one of the positioning features with the observed fouling location and then vibrates. More complex implementations may make use of the multiple positioning features. For example, the strip may be dimensioned to fit along one side (pressure side or suction side) of the airfoil. Particular locations may be known as likely candidates for fouling. Each of these locations may have an associated positioning feature (e.g., typically likely only two or three such features being appropriate). Based upon the radiographic inspection, a technician may place the buffer on the element and then sequentially engage the vibrator to one or more of the features to vibrate the airfoil at the associated target location. Alternatively, the multiple positioning features may provide redundancy. For example, the symmetric illustrated buffer element allows a technician to use either feature to address a given location on the blade (such as by a 180° rotation). This may approximately double the life of the buffer element as the positioning features wear or break off (e.g., due to vibration fatiguing the tack weld.)

By targeting locations of fouling and vibrating proximate those locations, the number of cycles may be greatly reduced. This can, for example, reduce the required number of cycles from something in the vicinity of ten to four or less. This may reduce overall time required for the multiple cycles.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline article configuration or process, details of such baseline may influence details of particular implementations. Accordingly, other embodiments are within the scope of the following claims.

What is claimed is:

1. A method for processing a turbomachine airfoil element, the airfoil element comprising a metallic substrate having:

an airfoil extending from a first end to a second end; and a cooling passageway system extending through the airfoil, the method comprising:

applying via a pneumatic vibrator an external vibration to an area of the airfoil element targeting internal fouling of the cooling passageway system;

flushing the cooling passageway system; and imaging the cooling passageway system, wherein:

the applying is via a pneumatic vibrator;

the applying comprises placing a buffer between the substrate and the pneumatic vibrator the placing is placing the buffer between the substrate and a tip of the pneumatic vibrator the buffer comprises:

a metallic strip having a first face and a second face opposite the first face;

a cushion along the first face and comprising a glass fiber tape; and means along the second face for registering the pneumatic vibrator.

2. The method of claim 1 further comprising:

an autoclave leaching between the applying and the flushing.

3. The method of claim 1 further comprising:

locating the internal fouling, if any remaining, via the imaging; and repeating:

the applying, the applying targeting the located internal fouling;

flushing;

imaging; and locating.

4. The method of claim 3 further comprising:

autoclave leaching after the vibrating and before the flushing.

5. The method of claim 4 further comprising:

conductivity testing and drying after the flushing and before the imaging.

6. The method of claim 1 further comprising:

conductivity testing and drying after the flushing and before the imaging.

7. The method of claim 1 further comprising:

autoclave leaching after the vibrating and before the flushing.

8. The method of claim 1 wherein:

the turbine element is a blade.

9. The method of claim 1 wherein:

the internal fouling is along a turn in the passageway system.

10. The method of claim 1 wherein:

the imaging is an x-ray imaging.

11. The method of claim 1 wherein the means comprises:

an elevated area surrounding a recess.

12. The method of claim 1 wherein the placing is placing the buffer between the substrate and a tip of the pneumatic vibrator.

13. The method of claim 12 wherein the means comprises:

an elevated area surrounding a recess.

14. The method of claim 1 wherein the means comprises:

a piece of sheet metal tack welded to the second face.

15. A method for processing a turbomachine airfoil element, the airfoil element comprising a metallic substrate having:

an airfoil extending from a first end to a second end; and a cooling passageway system extending through the airfoil, the method comprising:

applying an external vibration to an area of the airfoil element targeting internal fouling of the cooling passageway system;

flushing the cooling passageway system; and imaging the cooling passageway system, wherein:

the applying is via a pneumatic vibrator;

the applying comprises placing a buffer between the substrate and the pneumatic vibrator;

the buffer comprises:

a metallic strip having a first face and a second face opposite the first face;

a cushion along the first face, the cushion comprising a glass fiber tape; and means along the second face for registering the tip of the vibrator; and the placing is placing the buffer between the substrate and a tip of the pneumatic vibrator.

16. A method for processing a turbomachine airfoil element, the airfoil element comprising a metallic substrate having:

an airfoil extending from a first end to a second end; and a cooling passageway system extending through the airfoil, the method comprising:

applying an external vibration to an area of the airfoil element targeting internal fouling of the cooling passageway system;

flushing the cooling passageway system; and imaging the cooling passageway system, wherein:

the applying is via a pneumatic vibrator;

the applying comprises placing a buffer between the substrate and the pneumatic vibrator;

the buffer comprises:

a metallic strip having a first face and a second face opposite the first face;

a cushion along the first face; and means along the second face for registering the tip of the vibrator, the means comprising a piece of sheet metal tack welded to the second face; and the placing is placing the buffer between the substrate and a tip of the pneumatic vibrator.

* * * * *